US005839399A

United States Patent [19]

Luce

[11] Patent Number: 5,839,399

[45] Date of Patent: Nov. 24, 1998

[54] CARTRIDGE-TYPE ROTARY VALVE

[76] Inventor: Norris R. Luce, 95 Indian Creek Rd., Apt. 139, Huntsville, Ala. 35806

[21] Appl. No.: 954,183

[22] Filed: Oct. 20, 1997

[51] Int. Cl.[6] ..... F01L 7/16

[52] U.S. Cl. ..... 123/80 BB; 123/80 DA; 123/190.4; 137/625.46; 137/625.21; 251/310

[58] Field of Search ..... 123/80 BA, 80 BB, 123/80 DA, 190.1, 190.4, 190.7; 137/625.46, 454.2, 625.21, 625.22, 596; 251/304, 310

[56] References Cited

U.S. PATENT DOCUMENTS

| | | | |
|---|---|---|---|
| 1,130,521 | 3/1915 | King | 123/80 BB |
| 1,304,839 | 5/1919 | White | 123/80 DA |
| 2,364,548 | 12/1944 | Ragsdale | 123/80 DA |
| 2,498,846 | 2/1950 | Ball | 123/80 DA |
| 3,526,215 | 9/1970 | Aspin | 123/80 DA |
| 3,989,025 | 11/1976 | Franco | 123/190.7 |
| 4,311,119 | 1/1982 | Menzies et al. | 123/190.8 |
| 4,773,364 | 9/1988 | Hansen et al. | 123/190.8 |

*Primary Examiner*—David A. Okonsky
*Attorney, Agent, or Firm*—John C. Garvin, Jr.; Stephen R. Arnold

[57] ABSTRACT

A two-way rotary manifold-selecting valve forming a combustion chamber for an internal combustion engine has a frusto-conical rotor nestingly residing in a housing having a frusto-conical passage communicating with the base of the housing. The housing has a pair of ports through the side, and the rotor has a side passage entering a portion of the slanting side of the rotor and exiting at the base of the rotor. The housing is open at the bottom, and may be affixed co-axially with a cylinder of a piston-type internal combustion engine so that the interior passage within the rotor forms the combustion volume of the cylinder. The small diameter ends of the housing passage and the rotor are disposed at the bottom of the assembly when so installed. A dry-lubricated refractory sealing assembly is emplaced around the rotor and extends outwardly therefrom to engage the inner housing surface, thus holding the rotor at a standoff distance. All wear is thus confined to the seal material and the housing wall. The seal material is chosen of a material which is preferentially abraded in use so that little if any abrasion occurs at the interior wall surface of the housing. A pressure element forces the rotor downward at all times, with the result that as the seal material wears away, the rotor merely sinks deeper into the frusto-conical housing cavity without losing sealing action. Different passages and port arrangements may be employed for other applications.

24 Claims, 4 Drawing Sheets

CARTRIDGE-TYPE ROTARY VALVE

TECHNICAL FIELD

The technical field of the invention is the fluid control valve art, and in particular the rotary valve art.

BACKGROUND OF THE INVENTION

High speed rotary valves, and in particular high speed rotary valves serving as combustion chambers for piston-type internal combustion engines are known in the art. U.S. Pat. No. 5,474,036 issued to Hansen and Cross discloses such a valve having a cylindrical rotor with a side passage communicating with the bottom of the rotor, the rotor being rotatable to place the side passage in a confronting relationship with an intake port and an exhaust port. Such valving systems offer a significantly lower flow impedance that do customary poppet valve systems. The valve housing is mounted directly above the cylinder of an internal combustion engine, and the rotor passage serves as the combustion chamber. Such valves traditionally have a cylindrical geometry and require elaborate seals surrounding the rotor side port to prevent blow-by. Such cylindrical valves suffer from the disadvantage that as the housing walls, the rotor faces, and the seals wear, undesirable blow-by will occur. There is a need for a valve design which minimizes such blow-by as the wearing process occurs.

SUMMARY OF THE INVENTION

The present invention relates to a rotary valve assembly particularly suited to be used as the head of a piston-type internal combustion engine. According to a feature of the invention a valve housing is provided with a frusto-conical passage extending downward from the top of a valve housing and tapering inwardly to exit the bottom of the housing. A frusto-conical rotor is configured to be nestingly received in the housing passage, the rotor having a side passage through a portion of its slanting surface communicating with the bottom surface of the rotor. At least two ports are provided through the sides of the valve housing so that rotation of the rotor to given positions will position the rotor side passage into selective confrontation with a chosen port. A pair of circumferentially extending seals positioned above and below the rotor side passage are affixed to the rotor and extend outwardly therefrom. These seals hold the rotor at a standoff distance from the housing passage walls. The seals are of the dry-lubricating type and the walls of the housing passage are chosen to be of sufficient hardness that the seals are preferentially abraded in operation without significant abrasive wear of the housing chamber wall. As the seals wear, the effect is merely to cause the rotor to sink deeper into the housing central passage, while still maintaining a sealing engagement with the passage walls.

According to related features of the invention, additional seals are provided in the form of ribs affixed to the rotor along its slanting sides and joining the upper and lower circumferential seals. According to further features of the invention, these seals are formed as a unitary element snapped into appropriately configured groove-shaped recesses in the rotor outer wall. A pressure plate and spring combination serves to keep the rotor firmly seated at all times. An axially mounted spark plug is positioned with its electrodes within the rotor passage, the rotor passage serving as the combustion chamber for a piston-type internal combustion engine.

According to a feature of the invention, not necessarily related to internal combustion engines, an alternative configuration employs a similar rotor but having its passage communicating generally between different portions of the rotor sides. Appropriately positioned ports in the sides of the housing allow selective communication between ports or alternatively a complete blocking of all flow therebetween.

These and other features of the invention will become apparent upon inspection of the drawings, the detailed description and the claims.

DETAILED DESCRIPTION

Figure 1:
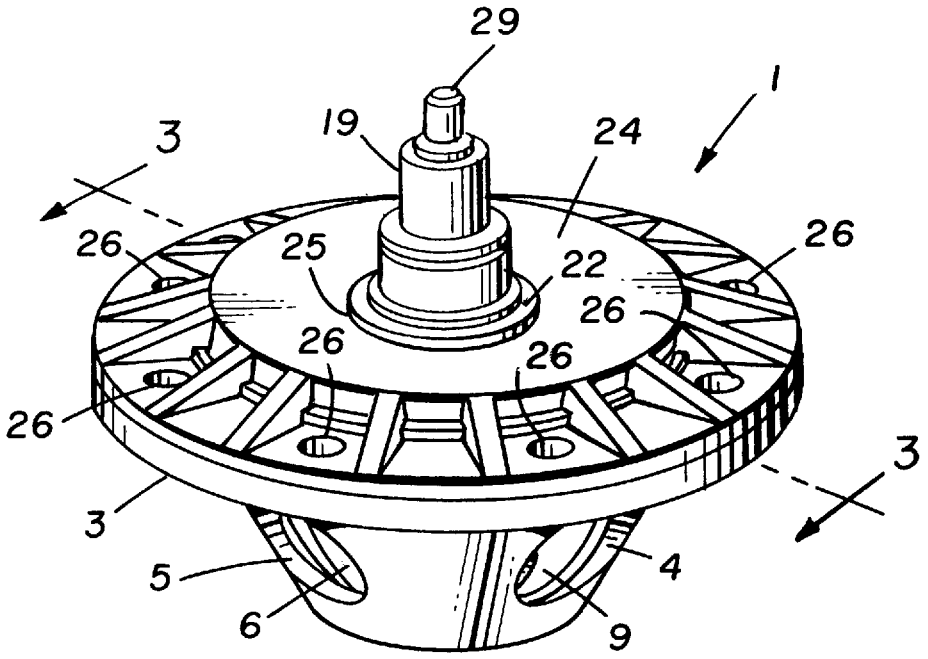
FIG. 1 is a perspective view of one version of a valve of the present invention.

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspects of the invention to the embodiments illustrated.

Figure 2:
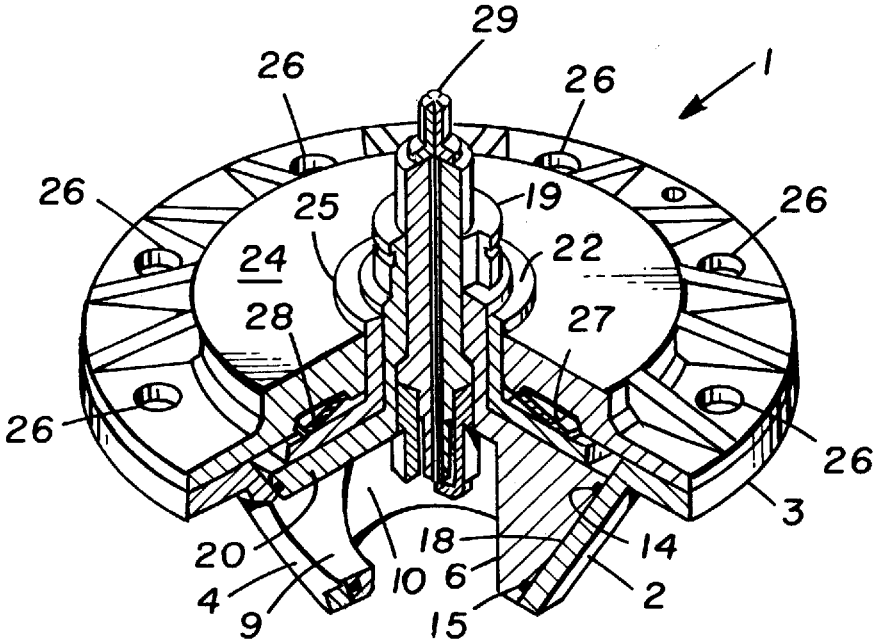
FIG. 2 is a partially cutaway view of the valve shown in FIG. 1.
Figure 3:
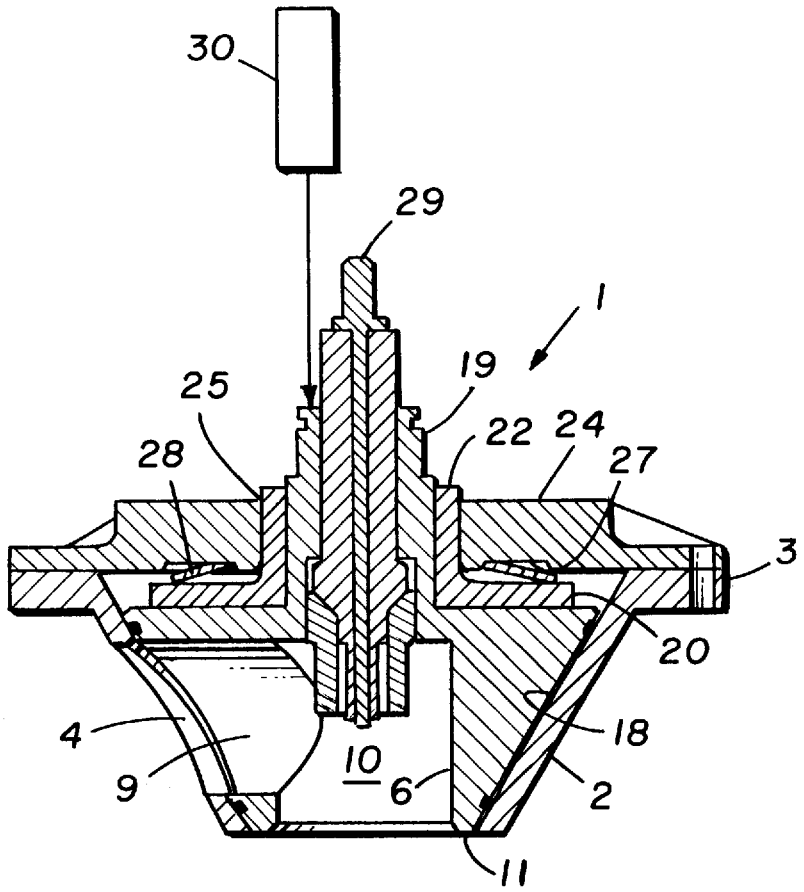
FIG. 3 is a cross-section view of the valve shown in FIG. 1 taken along the cut lines shown in FIG. 1.
Figure 4:
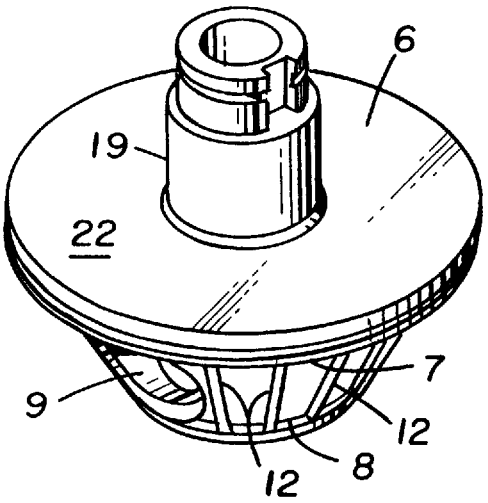
FIG. 4 is a perspective view of a rotor associated with the valve of the present invention.
Figure 5:
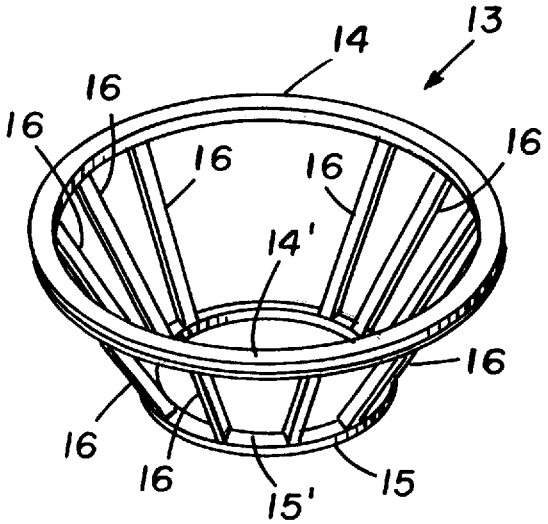
FIG. 5 is a perspective view of a seal assembly used in the valve.
Figure 6:
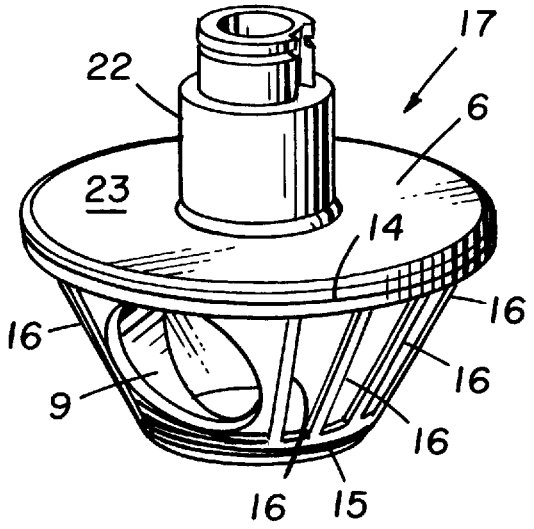
FIG. 6 is a perspective view showing the seal assembly of FIG. 5 mounted to the rotor of FIG. 4.

Referring now to the drawings, and in particular to FIGS. 1–3, a valve assembly 1 comprises a housing 2 (see also FIG. 7) having a frusto-conical central passage tapering inwardly and extending downward from a mounting flange 3. A pair of ports 4, 5 pass through the sides of the housing 2. A frusto-conical rotor 6 (see also FIG. 4) is configured to the nestingly received within the housing 2. The rotor 6 has a pair of circumferential grooves located above and below an entry 9 to an interior passage 10 exiting the rotor bottom 11. A plurality of rib grooves 12—12 connect the circumferential grooves 7, 8 at various points around the periphery of the slanting side of the rotor 6. A seal assembly 13 (see also FIG. 5) comprises an upper circumferential seal 14 and a lower circumferential seal 15 joined by a plurality of seal ribs 16—16 spaced around the structure as shown. The upper circumferential seal 14 and the lower circumferential seal 15 are slitted at points 14' and 15' and can be separated to allow the seal assembly 13 to be slipped over the rotor 6 and captively secured by the rotor grooves 7, 8, 12—12. FIG. 6 shows the completed rotor assembly with the seal assembly 13 in place.

As will be seen from FIGS. 1–3, the seal assembly 13 causes the rotor 6 to be supported at a standoff distance from the interior conical surface 18 of the housing 2. A rotor driveshaft 19, preferably integral with the rotor 6 is provided to drive the rotor 6 into rotation by external means. A pressure plate 20 having a planar lower face 21 has an upwardly extending central bushing 22 and rests against the planar upper face 22 of the rotor 6. The bushing 22 is mounted on the drive shaft 19 and is secured against rotation by a key way groove 23 (FIG. 2) which allows axial movement of the pressure plate up and down along the drive shaft 19, but holds it otherwise stationary. A cover plate 24 having a central plate passage 25 configured to accept the bushing 22 secures the structure together via bolt holes 26—26 for accommodating nuts and bolts (not shown) via counterpart holes 26'—26' in the cover plate 24. The lower face of the pressure plate 20 is provided with an annular groove 27 with a belleville spring washer 28 disposed therein. The purpose of the spring washer 28 is to insure a positive pressure of chosen amount to force the rotor assembly 17 firmly down into the housing central passage 18. As shown in FIGS. 1–3, a centrally located spark plug 29 extends along the axis of the driveshaft 19 into the center of the rotor passage 10. This particular embodiment is particularly adapted for use with an internal combustion engine, as will be discussed subsequently. Alternatively, the requisite downward force on the rotor 6 may be supplied by means of an external actuator 30 bearing on the bushing 19. Such an actuator 30 may take a variety of forms, such as hydraulic, pneumatic, or an appropriately configured mechanical linkage. As will be evident from the drawings, rotation of the rotor 6 in a given direction will selectively communicate port 4 or port 5 (FIG. 1) with the rotor passage 10.

The seal assembly 13 is preferably made of material of the dry-lubricating refractory type. A preferred material would be sintered amorphous carbon-graphite. Because of the presence of graphite, this material is self-lubricating and is capable of withstanding high temperatures up to 500 degrees Fahrenheit. Under abrasive wear, the amorphous carbon-graphite will abrade to a fine powder which is in itself self-lubricating, and as is evident from the structure of the valve assembly 1, will be wiped toward the ports 4, 5 to be ejected by centrifugal forces.

It is important that the seal assembly 13 be preferentially eroded with respect to the confronting surfaces of the housing 18. To achieve this the confronting portions of the inner surface 18 of the housing 2 should be polished and have a hardness value of at least 2M. This in combination with the amorphous carbon-graphite seal yields a low-friction system with abrasive wear essentially totally confined to the seal material. As a result, as the seals wear the sealing action is maintained because the pressure plate 20 under the influence of the belleville spring washer 28 causes the rotor assembly to sink lower into the housing 2. Seal wear may be monitored by monitoring the height of the bushing 22 above the cover plate 24. When the seal assembly 13 has reached a given state of wear, the top plate may be removed, a new rotor installed, and the system re-installed without necessitating a grinding and polishing operation on the housing inner face 18. The insertable assembly may properly be considered a cartridge-type unit in this sense.

Similarly, the pressure plate 20 is in a constant state of engagement with the rotating rotor 6 and it is preferred that the pressure plate 20 also be made of amorphous carbon-graphite material. The confronting upper face 22 (FIG. 4) of the rotor 6 must also be polished and have a surface hardness of at least 2M.

Figure 7:
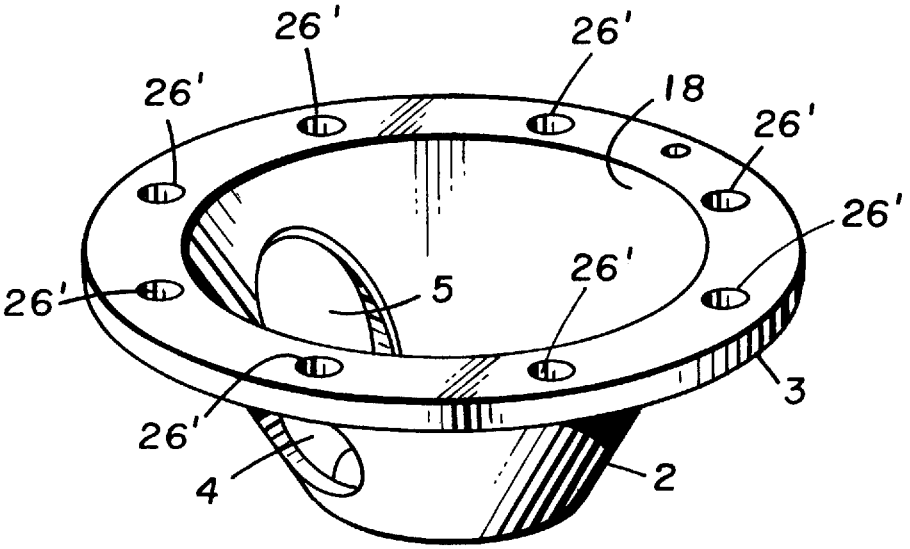
FIG. 7 is a perspective view of a housing for the valve.
Figure 8:
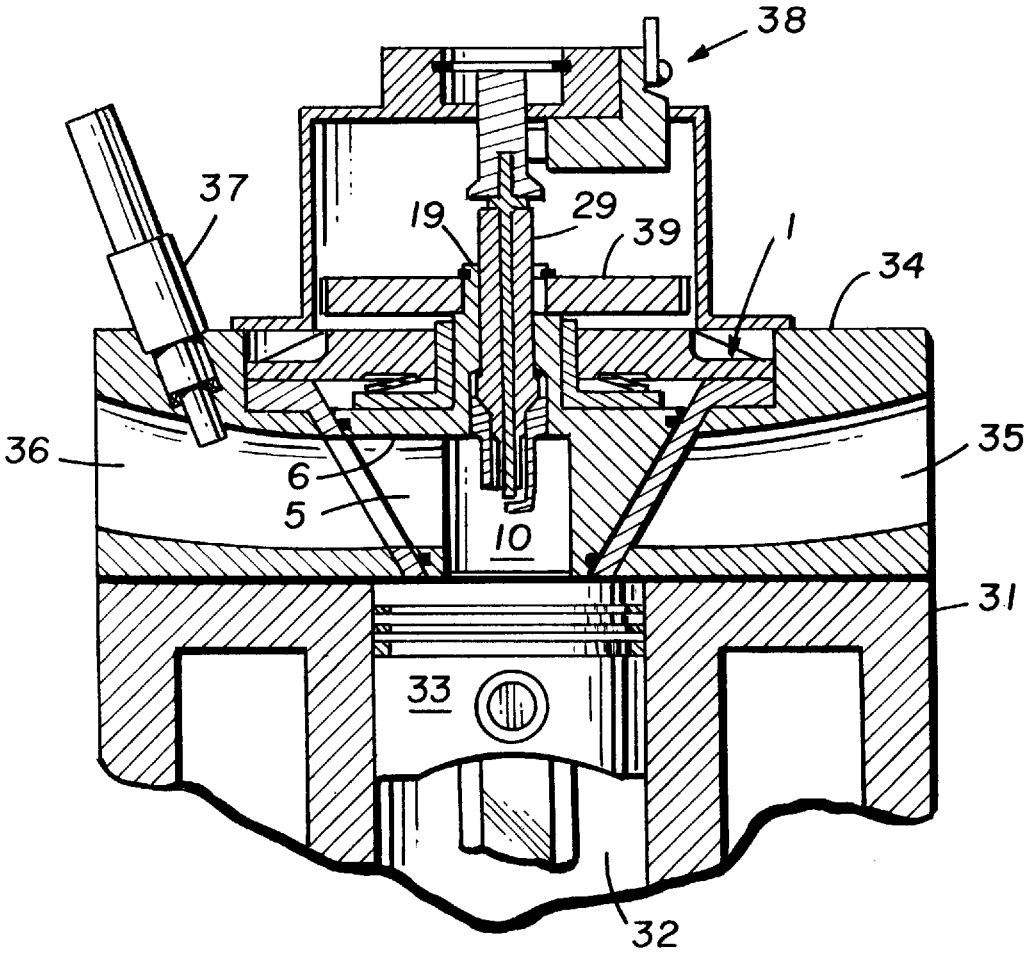
FIG. 8 is a cross-section view of one version of the valve of the present invention installed to form the head of an internal combustion engine.

FIG. 8 shows the valve assembly 1 incorporated into a reciprocating piston internal combustion engine. A portion of the engine is shown, showing portions of an engine block 31 containing a cylinder 32 and a piston 33. The valve assembly 1 is mounted to a manifold housing 34 which in turn is affixed to the block 31. Here the entire interior chamber 10 of the valve serves as the combustion chamber. The passages 35, 36 are both part of an intake manifold passing behind the valve assembly 1 and communicating with port 5 (See FIG. 7) of the valve assembly 1. Port 4 of FIG. 7 is not shown in the drawing, as it has been cut away. A fuel injector 37 is positioned to deliver fuel to passage 36. Surmounting the valve assembly 1 is a rotary contactor assembly 38 for making contact to the spark plug 29. A drive gear 39 is affixed to the drive shaft 19 to drive the rotor 6 into rotation by means not shown.

Figure 9:
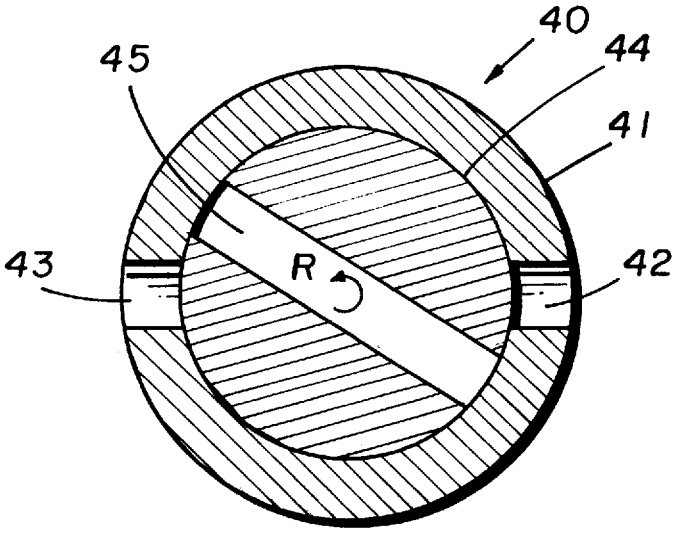
FIG. 9 is a schematic cross-section view of alternative configuration of the valve shown in the previous Figures.

FIG. 9 is a schematic cross-section view of an alternative version of valve assembly 40, showing a housing 41 with a pair of ports 42, 43 disposed on opposite sides thereof. The rotor 44 has a central passage 45 diametrically disposed therethrough so that rotation of the rotor 44 in the direction of the rotational arrow R will rotate the passage 45 from the non-confronting position shown in FIG. 9 to a position where it communicates between ports 42 and 43. A seal assembly similar to that shown in FIG. 5, with the ribs suitably disposed to accommodate the ends of the passage 45 may readily configured.

A great many variants of such a flow-through valve are possible, including multiple passages and additional ports, according to the needs of a given situation. Similar considerations apply to the valve version shown in FIGS. 1–3. The valves disclosed herein have application to liquid-flow systems as well.

Further, with respect to FIGS. 1, 2, 3, 7 and 9, it will be evident to those of ordinary skill in the art that where necessary each port may be readily connected to a flange-bearing pipe to facilitate connection to other parts of a flow system.

While the invention has been described with reference to a preferred embodiment, it will be understood by those skilled in the art the various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to a particular embodiment disclosed as the best mode contemplated for carrying out the invention, but that the invention will include all embodiments falling within the scope of the appended claims.

I claim:

1. A rotary valve comprising:

a valve housing having upper and lower housing surfaces and having a housing central passage extending from said housing upper surface to said housing lower surface, at least the upper portion of said housing central passage being configured as a frusto-conical passage of decreasing diameter extending downwardly away from said housing upper surface, said housing having at least one port disposed between said upper and lower housing surfaces and communicating between said upper central passage portion and the outside of said housing;

a frusto-conical rotor having upper and lower rotor surfaces and a slanting side surface of diameter decreasing downwards away from said rotor upper surface, and configured to allow said rotor to be nestingly received in said upper central passage portion, said rotor further having a rotor passage entering said slanting side surface and exiting said rotor lower surface and positioned so that rotation of said rotor to given positions places the entry region of said rotor passage alternatively in a confronting or nonconfronting relationship with said at least one port; and a plurality of centering barriers affixed to said slanting side surface of said rotor and extending outwardly therefrom to engage regions of said upper central passage portion to support said rotor at a standoff distance, said barriers being made of material substantially less abrasion-resistant than the confronting surfaces of said upper central passage, so that wear is substantially completely confined to said barriers.

2. The valve of claim 1 wherein said barriers are configured along their respective lengths to act as flow-by seals.

3. The valve of claim 2 wherein said barriers include upper and lower circumferentially extending barriers disposed to contactingly confront regions of said upper central passage portion in regions above and below said at least one port.

4. The valve of claim 3 wherein said barriers include a plurality of rib-forming barriers spanning between said upper and lower circumferentially extending barriers and disposed at intervals around said rotor.

5. The valve of claim 4 further including biasing means for urging said rotor downwards into said central passage.

6. The valve of claim 5 wherein said rotor has associated therewith a centrally disposed driveshaft extending axially upwardly therefrom, said valve further including a cover plate affixable to said upper surface of said housing and having a central passage therein to accommodate said driveshaft, and a pressure plate disposed between said rotor upper surface and said cover plate and having a central passage therethrough to accommodate said driveshaft and permit axial movement of said pressure plate along said driveshaft.

7. The valve of claim 6 wherein said biasing means includes at least one spring element disposed between said cover plate and said pressure plate to urge said rotor away from said cover plate.

8. The valve of claim 6 wherein said biasing means includes an actuator external to said valve and coupled to act on said pressure plate to urge said rotor away from said cover plate.

9. The valve of claim 7 in combination with a cylinder of a reciprocating piston internal combustion engine, said valve being affixed to the top of said cylinder to serve as the head of said cylinder with the rotational axis of said rotor aligned with the axis of said cylinder, said valve housing having two of said ports and a spark plug mounted axially within said driveshaft with its electrodes located within said rotor passage, so that said rotor passage serves as at least part of the combustion volume of said cylinder.

10. The valve of claim 8 in combination with a cylinder of a reciprocating piston internal combustion engine, said valve being affixed to the top of said cylinder to serve as the head of said cylinder with the rotational axis of said rotor aligned with the axis of said cylinder, said valve housing having two of said ports and a spark plug mounted axially within said driveshaft with its electrodes located within said rotor passage, so that said rotor passage serves as at least part of the combustion volume of said cylinder.

11. The valve of claims 4, 8, 9, or 10 wherein said barriers are made of dry-lubricating material.

12. The valve of claim 11 wherein said circumferentially extending barriers are joined to said rib-forming barriers to form a one-piece construction.

13. The valve of claim 12 wherein said rotor is provided with a plurality of grooves configured to retainingly accept said barriers.

14. A rotary valve comprising:

a valve housing having upper and lower housing surfaces and having a housing central concavity having a wall configured as at least a portion of a conical surface of decreasing diameter extending downwardly away from said housing upper surface, said housing having at least two ports disposed between said upper and lower housing surfaces and communicating between different portions of said central concavity and the outside of said housing;

a frusto-conical rotor having upper and lower rotor surfaces and a slanting side surface of diameter decreasing downwards away from said rotor upper surface, and configured to allow said rotor to be nestingly received in said central concavity, said rotor further having at least one cross-passage extending between different regions of said slanting side surface, said passage being configured and said ports being disposed so that rotation of said rotor to a given position places said cross-passage in a communicating relationship with said ports and so that further rotation of said rotor places the ends of said cross-passage in a nonconfronting relationship with said ports; and a plurality of centering barriers affixed to said slanting side surface of said rotor and extending outwardly therefrom to engage regions of said central concavity to support said rotor at a standoff distance, said barriers being made of material substantially less abrasion-resistant than the confronting surfaces of said central concavity, so that wear is substantially completely confined to said barriers.

15. The valve of claim 14 wherein said barriers are configured along their respective lengths to act as flow-by seals.

16. The valve of claim 15 wherein said barriers include upper and lower circumferentially extending barriers disposed to contactingly confront regions of said central concavity in regions above and below said at least two ports.

17. The valve of claim 16 wherein said barriers include a plurality of rib-forming barriers spanning between said upper and lower circumferentially extending barriers and disposed at intervals around said rotor.

18. The valve of claim 17 further including biasing means for urging said rotor downwards into said central concavity.

19. The valve of claim 18 wherein said rotor has associated therewith a centrally disposed driveshaft extending axially upwardly therefrom, said valve further including a cover plate affixable to said upper surface of said housing and having a central passage therein to accommodate said driveshaft, a pressure plate disposed between said rotor upper surface and said cover plate and having a central passage therethrough to accommodate said driveshaft and permit axial movement of said pressure plate along said driveshaft.

20. The valve of claim 19 wherein said biasing means includes at least one spring element disposed between said cover plate and said pressure plate to urge said rotor away from said cover plate.

21. The valve of claim 19 wherein said biasing means includes an actuator external to said valve and coupled to act on said pressure plate to urge said rotor away from said cover plate.

22. The valve of claims 17, 20, or 21 wherein said barriers are made of dry-lubricating material.

23. The valve of claim 22 wherein said circumferential by extending barriers are joined to said rib-forming barriers to form a one-piece construction.

24. The valve of claim 23 wherein said rotor is provided with a plurality of grooves configured to retainingly accept said barriers.

* * * * *